US008338763B2

(12) United States Patent
Nordh et al.

(10) Patent No.: US 8,338,763 B2
(45) Date of Patent: Dec. 25, 2012

(54) MICROWAVE OVEN WITH A REGULATION SYSTEM USING FIELD SENSORS

(75) Inventors: Ulf Erik Nordh, Norrkoping (SE); Olle Niklasson, Finspong (SE); Fredrik Hallgren, Kolmarden (SE); Hakan Carlsson, Norrkoping (SE)

(73) Assignee: Whirlpool Corporation, Benton Harbor, MI (US)

( * ) Notice: Subject to any disclaimer, the term of this patent is extended or adjusted under 35 U.S.C. 154(b) by 477 days.

(21) Appl. No.: 12/754,083

(22) Filed: Apr. 5, 2010

(65) Prior Publication Data

US 2010/0252551 A1 Oct. 7, 2010

(30) Foreign Application Priority Data

Apr. 7, 2009 (EP) ..... 09157516

(51) Int. Cl.
*H05B 6/68* (2006.01)

(52) U.S. Cl. ..... 219/702; 219/709

(58) Field of Classification Search ..... 219/702, 219/704, 705, 709, 716, 717
See application file for complete search history.

(56) References Cited

U.S. PATENT DOCUMENTS 4,009,359 A * 2/1977 Tallmadge et al. ..... 219/705
4,303,818 A * 12/1981 Smith ..... 219/707
4,771,153 A * 9/1988 Fukushima et al. ..... 219/709
5,632,921 A 5/1997 Risman et al.
5,693,247 A * 12/1997 Bu et al. ..... 219/711
2010/0187224 A1* 7/2010 Hyde et al. ..... 219/720

FOREIGN PATENT DOCUMENTS

GB 2425415 A 10/2006
WO 01/52604 A1 7/2001

* cited by examiner

*Primary Examiner* — Tom Thomas
*Assistant Examiner* — Christopher M Roland
(74) *Attorney, Agent, or Firm* — Jason S. Burnette

(57) ABSTRACT

A microwave heating device and a method for heating a load using microwaves are provided. The microwave heating device comprises a cavity adapted to receive a load and at least two microwave sources for feeding microwave energy into the cavity through at least two feeding ports respectively. The microwave heating device further comprises at least two field sensors adapted to measure field strengths of the microwave energy in the cavity. A first field sensor is arranged at a first location for measuring the field strength representative of a mode fed from a first feeding port and a second field sensor is arranged at a second location for measuring the field strength representative of a mode fed from a second feeding port. The microwave heating device further comprises a control unit connected to the microwave sources and the field sensors for regulating the microwave sources based on the measured field strengths. The present invention is advantageous in that it enables uniform heating of the load in the cavity.

15 Claims, 5 Drawing Sheets

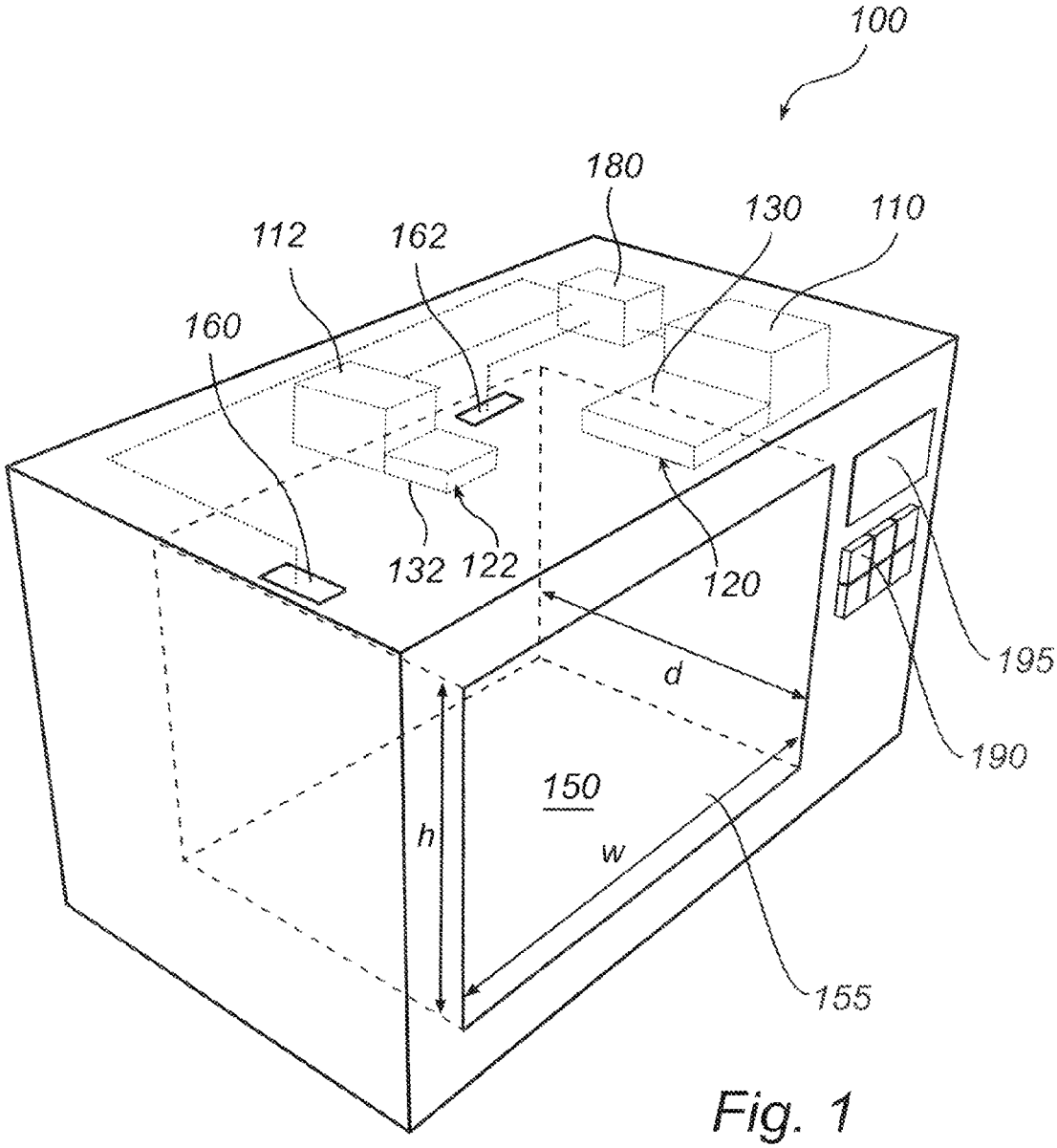
Fig. 1
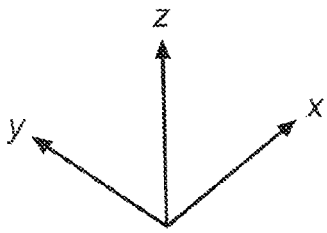

MICROWAVE OVEN WITH A REGULATION SYSTEM USING FIELD SENSORS

BACKGROUND OF THE INVENTION

1. Field of the Invention

The present invention relates to the field of microwave heating and in particular to regulation of microwave heating devices.

2. Description of the Related Art

The art of microwave heating involves feeding of microwave energy into a cavity. When heating a load in the form of e.g. food by means of a microwave heating device, there are a number of aspects which have to be considered. Most of these aspects are well-known to those skilled in the art and include, for instance, the desire to obtain uniform heating of the food at the same time as a maximum amount of available microwave power is absorbed in the food to achieve a satisfactory degree of efficiency.

As known to a person skilled in the art, uneven heating when using microwave energy may be due to the presence of hot and cold spots in the mode field. Traditional solutions to eliminate, or reduce, the effect of hot and cold spots are the use of a turntable to rotate the load in the cavity of the microwave oven during heating or the use of a so-called "mode stirrer" to continuously alter the mode patterns within the cavity. Drawbacks of such techniques are that they are not fully satisfying in terms of heating uniformity and that they involve rotating or moving parts.

Alternatively, as disclosed in U.S. Pat. No. 5,632,921, a microwave oven with a quadratic arrangement between a first and a second feed aperture and a phase-shift of ninety degrees between the microwaves input from a first waveguide feed connected to the first feed aperture and a second waveguide feed connected to the second feed aperture may be provided to produce a rotating microwave pattern in the cavity, thereby producing a more even heating. However, a drawback is that such a microwave oven requires a rather advanced structure for feeding the microwaves into the cavity of the microwave oven and a non-standard design of the cavity.

Thus, there is a need for providing new methods and devices that would overcome these problems.

SUMMARY OF THE INVENTION

An object of the present invention is to provide an improved alternative to the above techniques and prior art.

Generally, it is an object of the present invention to provide a microwave heating device improving heating uniformity.

This and other objects of the present invention are achieved by means of a method and a microwave heating device having the features defined in the independent claims. Preferable embodiments of the invention are characterized by the features of the dependent claims.

Hence, according to a first aspect of the present invention, a microwave heating device as defined in claim 1 is provided. The microwave heating device comprises a cavity and at least two microwave sources for feeding microwave energy into the cavity via at least two feeding ports, respectively. The microwave heating device further comprises at least two field sensors for measuring the field strengths of the microwave energy in the cavity and a control unit for regulating the microwave sources based on the measured field strengths. A first field sensor is arranged at a first location for measuring the field strength representative of a mode fed from a first feeding port and a second field sensor is arranged at a second location for measuring the field strength representative of a mode fed from a second feeding port.

According to a second aspect of the present invention, a method of heating a load using microwaves as defined in claim 12 is provided.

The present invention makes use of an understanding that a microwave heating device can be equipped with at least two field sensors for sensing the microwave field at specific locations in the cavity of the microwave heating device. The first field sensor is arranged at a first location where the field strength representative of the mode fed from the first feeding port can be measured while the second field sensor is arranged at a second location where the field strength representative of the mode fed from the second feeding port can be measured. It will be appreciated that the first location, where the field strength representative of the mode fed from the first feeding port can be measured, does not correspond to a single location in the cavity. The same applies for the second location. In other words, the field sensors may be arranged at any position (or location) in the cavity such that the field strength of the mode fed from the first feeding port is measured by the first field sensor and the field strength of the mode fed from the second feeding port is measured by the second field sensor. The microwave sources generating the microwaves transmitted to the cavity are then regulated in accordance with the measurements made with the field sensors. Upon a change or variation of the measurement obtained by the field sensors, the control unit of the microwave heating device will regulate at least one parameter of at least one of the microwave sources. The method and microwave heating device of the present invention are advantageous in that the heating pattern resulting from the modes fed from the feeding ports into the cavity can be controlled. In particular, the method and microwave heating device of the present invention are advantageous in that uniform heating in the cavity can be achieved.

The present invention is also advantageous in that it does not require any moving or rotating part, thereby providing a microwave heating device which is mechanically reliable.

According to an embodiment, the first field sensor may be arranged at a region of the cavity corresponding to a maximum field strength for the mode fed from the first feeding port and the second field sensor may be arranged at a region of the cavity corresponding to a maximum field strength for the mode fed from the second feeding port, which is advantageous in that the signals measured by the field sensors have a relatively large amplitude (at least in comparison to signals measured if the field sensors were arranged at regions of the cavity corresponding to minimum field strengths), thereby increasing accuracy of the measurements.

According to an embodiment, the mode fed from the first feeding port may be a hot-centre mode and the mode fed from the second feeding port may be a cold-centre mode, which is advantageous in that it provides two complementary heating patterns, thereby facilitating uniform heating in the cavity.

According to an embodiment, the control unit may be adapted to regulate the microwave sources for sequential feeding of the microwaves into the cavity via the feeding ports. Although simultaneous feeding of the microwaves into the cavity is also envisaged in the microwave heating device and method of the present invention, sequential feeding is advantageous in that the risk for decoupling of unwanted frequency components inside the cavity is eliminated, or at least reduced. Using simultaneous feeding of microwaves of e.g. two different frequencies via two feeding ports, respectively, these unwanted frequency components are induced because of a subtraction process. Further, sequential feeding is advantageous in comparison to simultaneous feeding in that the risk for field cancellation in the cavity is eliminated, or at least reduced.

A number of parameters may be regulated by the control unit. For example, in the case of sequential feeding, the control unit may be adapted to regulate, for an operation cycle, a sequence order of the feeding ports for sequential feeding of the microwaves into the cavity. Further, the control unit may be adapted to regulate the time of operation of each of the microwave sources during a portion of the operation cycle (time of operation for feeding from each of the feeding ports). Further, the control unit may be adapted to regulate the output power level of at least one of the microwave sources. Further, the control unit may be adapted to regulate the frequency of the microwaves generated by at least one of the microwave sources. Further, although it is less relevant for sequential feeding, the control unit may be adapted to regulate the phase of the microwaves generated by the microwave sources.

In the case of simultaneous feeding, the control unit may be adapted to regulate at least one parameter of the group comprising the frequency, the output power level and the phase of the microwaves generated by at least one of the microwave sources.

According to an embodiment, the microwave heating device may further comprise at least one additional sensor arranged at a third location of the cavity for measuring the field strength representative of one of the modes fed from the first or second feeding port, which is advantageous in that mode distortion can be determined. For example, an additional sensor may be arranged in the cavity for measuring a field strength representative of the mode fed from the first feeding port. If a variation in the field (or signal) strength measured by the first field sensor is observed, the difference or comparison between the field strengths measured by the first and additional sensors may be used to determine whether the mode fed from the first feeding port is distorted. The control unit may then be adapted to, based on whether the mode is distorted, regulate at least one of the parameters of the microwave sources, such as for example the frequency and the output power level.

Generally, a mode distortion may be caused by, e.g., a change in the load, such as a change in geometry, weight or state of the load. In the example above, such a change may mean that the first microwave source is not operated at a frequency corresponding to a reflection minimum or resonance in the cavity. In that case, the control unit may be adapted to regulate the frequency of the first microwave source such that the microwave source is operated at a frequency corresponding to a reflection minimum (other examples of possible regulation will be described in more detail in the following). Thus, the present invention is also advantageous in that it provides a microwave heating device with improved energy efficiency as the microwave sources are operated at frequencies corresponding to reflection minima.

According to an embodiment, the additional sensor is arranged at a location corresponding to a minimum (or comparatively low) field strength for the mode fed from the first or second feeding port, which is advantageous in that the sensitivity in detecting a mode distortion is optimized, or at least improved. For example, in an extreme case of mode distortion, the strengths measured by the first and the additional field sensors may be reversed, wherein the first field sensor measures a minimum field strength and the additional field sensor measures a maximum field strength.

According to another embodiment, the microwave heating device may further comprise a measuring unit for measuring a signal reflected from the cavity as a function of the operating frequency of the microwave source associated with one of the first or second feeding port, which is advantageous in that it can be determined whether a variation in a measured field strength originates from a change in reflection characteristics of the first or second feeding port. For example, a reason for the decrease of the field strength measured at the first field sensor may be the increase of the signal reflected from the cavity to the first feeding port. The control unit may then be adapted to regulate the microwave source associated with the first feeding port accordingly.

According to an embodiment, the control unit may be adapted to regulate the microwave sources such that the difference between the measured field strengths is below a predetermined value. Alternatively, the control unit may be adapted to regulate the microwave sources such that the difference between the measured field strengths is comprised within a predetermined range. Alternatively, the control unit may be adapted to regulate the microwave sources such that the difference between the measured field strengths is kept constant.

For regulation (or tuning) of the frequency, output power level and/or phase of the microwaves fed into the cavity, the microwave sources are preferably solid-state based microwave generators.

Further objectives, features and advantages of the present invention will become apparent when studying the following detailed disclosure, the drawings and the appended claims. Those skilled in the art realize that different features of the present invention can be combined to create embodiments other than those described in the following.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, in which:

FIG. 1 schematically shows a microwave heating device according to an embodiment of the present invention;

Figure 2:
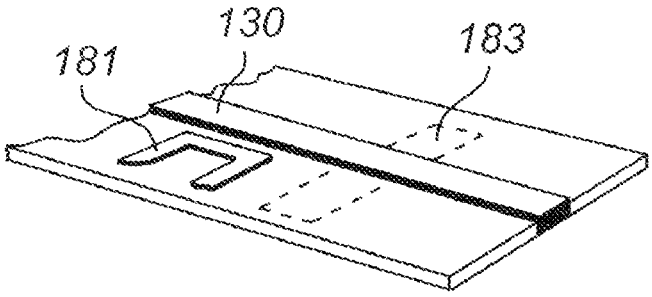
FIG. 2 schematically shows an example of a measuring unit for measuring reflection characteristics at a feeding port.

All the figures are schematic, not necessarily to scale, and generally only show parts which are necessary in order to elucidate the invention, wherein other parts may be omitted or merely suggested.

DETAILED DESCRIPTION OF THE PREFERRED EMBODIMENTS

With reference to FIG. 1, there is shown a microwave heating device 100, e.g. a microwave oven, having features and functions according to an embodiment of the present invention.

The microwave oven 100 comprises a cavity 150 defined by an enclosing surface. One of the side walls of the cavity 150 may be equipped with a door 155 for enabling the introduction of a load, e.g. a food item, in the cavity 150. Further, the cavity 150 is provided with at least two feeding ports, a first feeding port 120 and a second feeding port 122, through which microwaves are fed into the cavity 150 of the microwave oven 100. The cavity 150 is generally made of metal.

Although the microwave oven 100 described with reference to FIG. 1 has a rectangular enclosing surface, it will be appreciated that the cavity of the microwave oven is not limited to such a shape and may, for instance, have a circular cross section, or other geometries describable in orthogonal curvilinear coordinates.

The microwave oven 100 further comprises at least two microwave sources 110 and 112 connected to the first and second feeding ports 120 and 122, respectively, of the cavity 150 by means of transmission lines or waveguides 130 and 132, respectively. In the example shown in FIG. 1, regular waveguides are used as transmission lines and the apertures are of the same size as the waveguide cross-section. However, this is not necessarily the case and a multitude of other arrangements can be used such as, e.g., E-probes, H-loops, helices, patch antennas and resonant high-E bodies arranged at the junction between the transmission line and the cavity. The transmission lines may for instance be coaxial cables or strip lines.

Further, the microwave oven 100 may comprise switches (not shown), each being associated with a feeding port arranged in the transmission line for stopping the feeding of a respective feeding port.

Generally, the present invention is applicable for microwave ovens comprising a cavity designed to support at least two mode fields (or modes).

In general, the number and/or type of available mode fields in a cavity are determined by the design of the cavity. The design of the cavity comprises the physical dimensions of the cavity and the location of the feeding port(s) in the cavity. The dimensions of the cavity are generally denoted by the reference signs h, d and w for the height, depth and width, respectively, such as shown in FIG. 1 provided with a coordinate system (x, y, z). The cavity 150 is designed such that it supports a first mode fed from the first feeding port 120 and a second mode fed from the second feeding port 122.

In addition, the two modes may be selected such that crosstalk is limited. For this purpose, the microwave oven 100 may optionally comprise a measuring unit 166 (shown in FIG. 5) for measuring, or being adapted to measure, for one of the feeding ports 120 or 122, a signal reflected from the cavity 150 as a function of the operating frequency of the microwave source 110 or 112, respectively, associated with the feeding port. It will be appreciated that each of the feeding ports may be equipped with such a measuring unit. As will be described in more detail in the following, microwaves transmitted to a cavity may be either absorbed by the load arranged in the cavity, absorbed by elements of the cavity such as the walls, dissipated in other apertures or ports of the cavity, or reflected back from the cavity (or feeding port). The reflected signal measured by a measuring unit is representative of the energy reflected from the cavity 150. For example, a switch associated with a feeding port may comprise a measuring unit for measuring the microwave power that is reflected from the corresponding feeding port.

In general, the reflected signal measured (in e.g. a circulator reflection "branch") at a feeding port generally denoted (i+1) may be used to determine the crosstalk induced during operation of a feeding port generally denoted i. The operating parameters for the feeding port i, typically the frequency of the microwaves, may then be adjusted accordingly (typically such that the signal measured at the feeding port denoted (i+1) is minimized). A similar measurement can be made at the feeding port i for adjusting the parameters for the feeding port (i+1). For the purpose of theoretical analysis, the so-called scattering matrix may be used, where each matrix element can be expressed as:

$$S_{ij} = \left| \begin{array}{c} i = j \Rightarrow \text{input reflection for port } j \\ i \neq j \Rightarrow \text{transmission from port } j \text{ to port } i \end{array} \right| \quad \text{(Equation 1)}$$

In the example described with reference to FIG. 1, i=1 or 2 and j=1 or 2. According to equation 1, the term $S_{11}$ corresponds to the signal going from the first generator 110 (associated with the first feeding port 120) and returning to the first feeding port 120 while the term $S_{22}$ corresponds to the signal going from the second generator 112 (associated with the second feeding port 122) and returning to the second feeding port 122. Similarly, the term $S_{12}$ corresponds to the signal detected at the first feeding port 120 when the second feeding port is active (second generator 112 is ON) and the first feeding port is inactive (e.g., the first generator 110 is OFF and/or feeding via the first feeding port is blocked). The term $S_{21}$ corresponds to the signal detected at the second feeding port 122 when the first feeding port 120 is active (first generator 110 is ON) and the second feeding port 122 is inactive (second generator 112 is OFF and/or feeding via the second feeding port 122 is blocked).

The measurement of the input reflection at a feeding port provides information about the coupling between the transmission line and the cavity. As mentioned above, the measurements may be performed at e.g. a reflection "branch" in the circulator.

The result of such a measurement may then be transmitted to a control means or unit 180 (explained in more detail below) which may use the measurements to control the frequency of the microwaves generated by the corresponding microwave source (e.g. control of the operating frequency of the microwave source). A way to control whether there is a satisfactory coupling to the cavity 150 is therefore by measuring the power that is reflected from a feeding port, e.g. at a switch. It will be appreciated that the level of the signal reflected at the feeding port may depend on the frequency of the transmitted microwaves. FIG. 2 shows a preferred example of how such measuring may be provided in the case with one feeding port, e.g. the first feeding port 120, which comprises a slot 183 in the ground plane. A directional coupler 181 is arranged adjacent to the transmission line 130 above, which is up-stream of, the slot 183. The directional coupler 181 is in the form of a line that runs parallel to the transmission line 130 across a distance which corresponds to a quarter of the wavelength of the microwaves in the line 130. Any microwave power being reflected will be detected via the directional coupler 181 and may subsequently be measured in an already known manner.

The measuring unit 166 may be either integrated as a sub-unit in the control unit 180 or arranged as a separate unit connected to the control unit 180.

Normally, the reflected signal is measured by the measuring unit 166 at the beginning of an operation cycle. However, as will be explained in more detail in the following, the measuring unit 166 may also be adapted to monitor the signal reflected from the cavity 150 dynamically, i.e. during an operation cycle. During operation, resonance frequencies identified at the beginning of an operation cycle may be used as reference values for determining whether the frequency of the microwaves transmitted to the cavity 150 is to be regulated. The measuring unit 166 may be adapted to measure the signal reflected from the cavity 150 after a pulse is sent by the microwave source 110. For the synchronization of the measurements in relation to, or within, the operation cycle, the microwave oven may further comprise a clock system.

Figure 3:
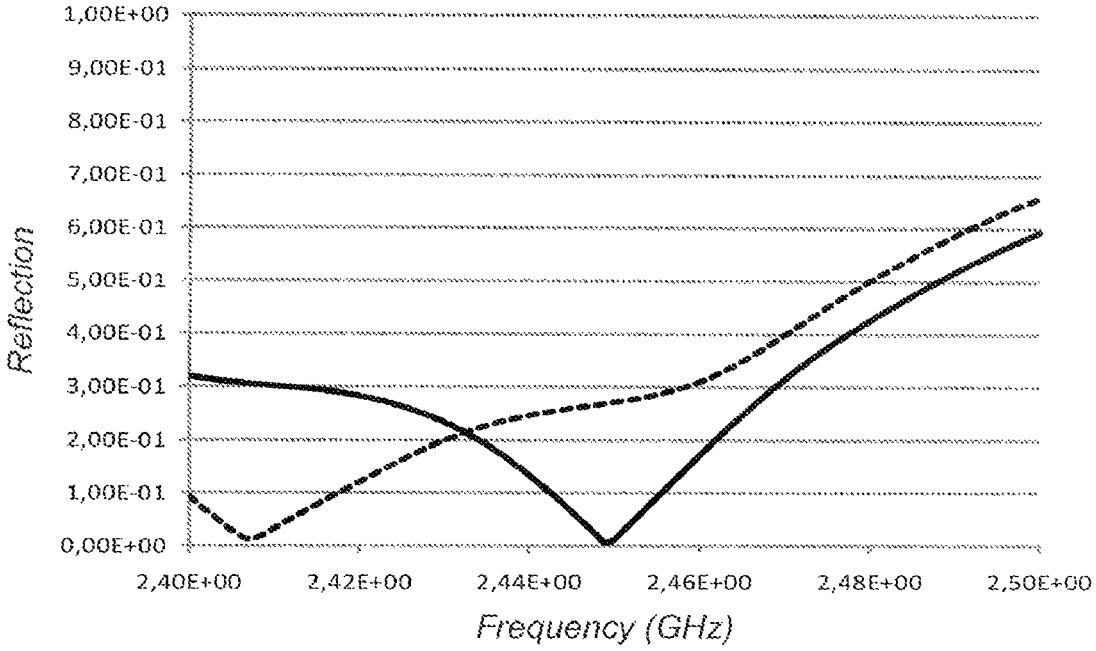
FIG. 3 shows the reflection characteristics for the twin-fed cavity shown in FIG. 1.

With reference to FIG. 3, an example of reflection characteristics for a twin fed cavity, such as the cavity 150 described with reference to FIG. 1, is shown. For the reflection characteristic represented with a dashed line, a reflection minimum is identified at about 2410 MHz while for the reflection characteristic represented with a solid line, a reflection minimum is identified at about 2450 MHz.

Advantageously, the cavity is designed to resonate for two different modes resulting in complementary heating patterns, i.e. resulting in a uniform heating of a dielectric load arranged in the cavity.

In general, a cavity with a load, for instance a typical cavity of 20-25 liters with a typical load of about 350 g, supports (or may be designed to support) two dominant modes, e.g. a hot-centre mode and a cold-centre mode. In such a microwave heating device, if the load is centered in the cavity, the center of the load is heated with the hot-centre mode while it is not heated, or at least less heated, with the cold-centre mode. Instead, the cold-centre mode is used to heat regions surrounding the centre of the load.

The feeding ports 120 and 122 may be arranged at, in principle, any of the walls of the cavity 150. However, there is generally an optimized location of the feeding port for a predefined mode. For examples, the feeding ports may be located at a side wall or the ceiling wall of the cavity 150. In the example shown in FIG. 1, the first feeding port 120 is arranged in the upper part of an interior side wall of the cavity, namely the right-hand side wall when opening the door 155 of the microwave oven. The second feeding port 122 is arranged in the upper part of the rear wall of the cavity 150, i.e. the wall of the cavity facing the front wall provided with a door 155. Further, it may be envisaged to implement the present invention using more than two feeding ports.

According to an embodiment, the microwave sources 110 and 112 are solid-state based microwave generators comprising, for instance, silicon carbide (SiC) or gallium nitride (GaN) components. Other semiconductor components may also be adapted to constitute the microwave sources. In addition to the possibility of controlling the frequency of the generated microwaves, the advantages of a solid-state based microwave generator comprise the possibility of controlling the output power level of the generator and an inherent narrow-band feature. The frequencies of the microwaves that are emitted from a solid-state based generator usually constitute a narrow range of frequencies such as 2.4 to 2.5 GHz. However, the present invention is not limited to such a range of frequencies and the solid-state based microwave sources 110 and 112 could be adapted to emit in a range centered at 915 MHz, for instance 875-955 MHz, or any other suitable range of frequency (or bandwidth). The present invention is for instance applicable for standard sources having mid-band frequencies of 915 MHz, 2450 MHz, 5800 MHz and 22.125 GHz. Alternatively, the microwave sources 110 and 112 may be frequency-controllable magnetrons such as that disclosed in document GB2425415.

Further, the microwave heating device 100 comprises at least two field sensors 160 and 162. A first field sensor 160 is arranged at a first location for measuring the field strength representative of the mode fed from the first feeding port 120 and a second field sensor 162 is arranged at a second location for measuring the field strength representative of the mode fed from the second feeding port 122.

Different types of field sensors for measuring microwaves field strengths are known by persons skilled in the art. The present invention is not limited to a single type of microwave field sensor and, generally, any type of microwave field sensor may be used. An example may be an electric probe inserted into the cavity at a suitable location. Advantageously, the electric probe is arranged such that the electric field component parallel with the probe is maximum. The coupling between the cavity mode electric field and the sensor is governed via the electric probe insertion into the cavity.

Advantageously, the first field sensor 160 is arranged in a region of the cavity corresponding to a maximum field strength for the mode fed from the first feeding port 120 and the second field sensor 162 is arranged in a region of the cavity corresponding to a maximum field strength for the mode fed from the second feeding port 122. In the example shown in FIG. 1, both the first and second field sensors 160 and 162 are arranged at the ceiling wall. The first field sensor 160 is arranged at the ceiling wall in a zone close to the side wall opposite to the side wall at which the first feeding port 120 is arranged. The second field sensor 162 is arranged at the ceiling wall in a zone close to the rear wall at which the second feeding port 122 is arranged. With such an arrangement, the microwave heating device 100 is sensitive to any variation in the signals measured by any one of the field sensors 160 and 162. It will be appreciated that, for a specific mode, it is sufficient to arrange the field sensor in a region corresponding to a maximum field strength and not necessarily at the exact position corresponding to the maximum field strength. For example, a mode is normally characterized by a specific heating pattern along a wall of the cavity and a particular location corresponding to a maximum field strength may be identified on this wall (such as the ceiling wall in the example described with reference to FIG. 1). A field sensor may be arranged at this particular location or in a region surrounding this particular location, provided that the signal measured by the field sensor for this specific mode is, e.g., kept over a particular threshold for this region or represents a predefined percentage of the maximum field strength.

Further, the microwave oven 100 comprises a control unit 180 for controlling the microwave sources 110 and 112 and, thereby, the properties (such as frequency, phase and power) of the microwaves transmitted into the cavity 150. The control unit 180 is connected to the microwave sources 110 and 112 and the field sensors 160 and 162 for regulating the microwave sources 110 and 112 based on the field strengths measured by the field sensors 160 and 162.

Using two feeding ports associated with two microwave sources, respectively, two different ways of feeding microwaves into the cavity exist, namely sequential feeding and simultaneous feeding.

In the following, sequential feeding of the microwaves into the cavity will be described in more detail.

Figure 4:
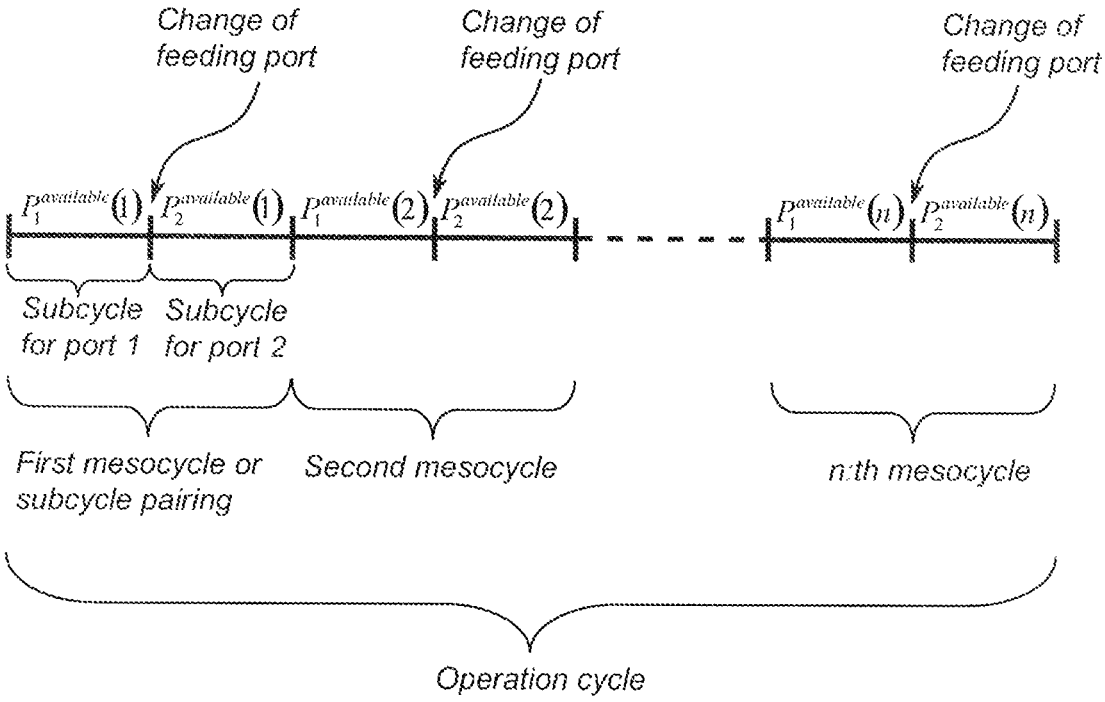
FIG. 4 shows an example of operation cycle for sequential feeding.

With reference to FIG. 4, for the purpose of describing sequential feeding, the heating time corresponding to an operation cycle is considered to be divided in a number of time portions called meso-cycles. A time portion (or meso-cycle) corresponds to a subcycle pairing comprising a subcycle for the first feeding port 120 during which microwaves are first fed from the first feeding port 120 (feeding of the second feeding port being unable, e.g. with the second microwave generator being off or the feeding of the second feeding port being blocked) and a subcycle for the second feeding port 122 during which microwaves are fed from the second feeding port 122 (feeding of the first feeding port being unable, e.g. with the first microwave generator being off or the feeding at the first feeding port being blocked). An operation cycle typically comprises a number n of time portions or meso-cycles.

In the following, the power available from a feeding port generally denoted i for the cavity during a sub-cycle generally denoted k is expressed as:

$$P_i^{available}(k)=P_i^{source}(k)-(k) \quad \text{(Equation 2)}$$

where k=(1, 2, 3, . . . ), i=(1,2), $P_i^{source}(k)$ k is the power available in the transmission line directly after the i:th microwave generator during sub-cycle k and $S_{ii}^2(k)$ is the square of the input reflection signal for feeding port i during sub-cycle k (such as defined in equation 1).

Expressing the input power fed from the first microwave generator 120 into the cavity 150 via the first feeding port 120 during the first sub-cycle as $P_1^{source}(1)$, the available power for the cavity 150 can then be expressed as $P_1^{source}(1)-S_{11}^2(1)$, in accordance with Equation 2. The power supplied by the first generator 120 can either be measured in the transmission line 130 before the cavity 150 or calculated via the power source transfer function of the generator and the efficiency of the generator.

Generally, the power transmitted via the first feeding port 120 and available to the cavity 150 during the first sub-cycle (1) is divided between the first feeding port 120 (input reflection power $S_{11}^2(1)$), the second feeding port 122 (power expressed as $S_{21}^2(1)$), the port 3 corresponding to the first field sensor 160 (expressed as $S_{31}^2(1)$), the port 4 corresponding to the second field sensor 162 (power expressed as $S_{41}^2(1)$), wall losses (power expressed as $P_{1,loss}^{wall}$), and dielectric food losses (power expressed as $P_{1,loss}^{dielectric}$), thereby resulting in the following expression:

$$P_1^{source}(1)-S_{11}^2(1)=S_{21}^2(1)+S_{31}^2(1)+S_{41}^2(1)+P_{1,loss}^{wall}(1)+P_{1,loss}^{dielectric}(1) \quad \text{(Equation 3)}$$

Analogously, the power transmitted via the second feeding port 122 and available to the cavity 150 during the first sub-cycle (1) (i.e. the second part of meso-cycle 1) can be expressed as:

$$P_2^{source}(1)-S_{22}^2(1)=S_{12}^2(1)+S_{32}^2(1)+S_{42}^2(1)+P_{2,loss}^{wall}(1)+P_{2,loss}^{dielectric}(1) \quad \text{(Equation 4)}$$

where $P_2^{source}(1)$ is the input power fed from the second microwave generator 120 into the cavity 150 via the second feeding port 122 during the first sub-cycle, $S_{22}^2(1)$ is the power corresponding to the input reflection to the second feeding port 122 (square of the input reflection signal), $S_{12}^2(1)$ is the power transmitted to the first feeding port 120, $S_{32}^2(1)$ is the power transmitted to port 3 corresponding to the first field sensor 160, $S_{42}^2(1)$ is the power transmitted to port 4 corresponding to the second field sensor 162, $P_{2,loss}^{wall}$ corresponds to wall losses and $P_{2,loss}^{dielectric}$ corresponds to dielectric food losses.

The powers detected by the first and second field sensors 120 and 122 during the first subcycle correspond to the terms $S_{31}^2(1)$ and $S_{42}^2(1)$, respectively.

In the following, only the first subcycle (1) during which the first feeding port is active, i.e. the first part of the first meso-cycle, is considered. It will be appreciated that the description of the subcycles during which the second feeding port is active, e.g. the second part of the first meso-cycle (1), is analogous. In addition, it will be appreciated that the analysis of the first meso-cycle is sufficient since the analysis of the remaining number of meso-cycles for defining the complete heating cycle is analogous.

As mentioned above, the first field sensor 160, corresponding to port 3 in the present example, is arranged at a location of the cavity for measuring the field strength of the mode fed from the first feeding port 120. Based on equation 3, the signal power at the first field sensor 120 can be expressed as:

$$S_{31}^2(1)=P_1^{source}(1)-S_{11}^2(1)-S_{21}^2(1)-S_{41}^2(1)-P_{1,loss}^{wall}(1)-P_{1,loss}^{dielectric}(1) \quad \text{(Equation 5)}$$

According to an embodiment, the second feeding port 122 and the second field sensor 162 arranged at a location for measuring the field strength of the mode fed from the second feeding port 122 are arranged orthogonal to the first feeding port 120 and its field sensor 122, such as shown in FIG. 1. Such an orthogonal arrangement provides low cross-coupling and reduced crosstalk. Thus, it is assumed that the terms $S_{21}^2(1)$ and $S_{41}^2(1)$ in Equation 5 are negligible.

In general, the cavity of a microwave heating device is made of low loss material and the wall losses are assumed to be constant (i.e., non-dispersive). Thus, the term $P_{1,loss}^{wall}(1)$ is also assumed to be negligible. For example, the interior of the cavity may be made of low loss material such as e.g. Zn-coated or Al-coated steel, thereby reducing power losses in the walls.

Further, it may also be assumed that a feeding port and its corresponding field sensor (e.g. the first feeding port 120 and the first field sensor 160) are suitably decoupled, e.g. using a dedicated transformer, such that the input power is not strongly dissipated in the corresponding field sensor.

The power detected at the first field sensor may then be expressed as:

$$S_{31}^2(1)=P_1^{source}(1)-S_{11}^2(1)-P_{1,loss}^{dielectric}(1)=P_1^{source}(1)-[P_{1,loss}^{dielectric}+S_{11}^2(1)] \quad \text{(Equation 6)}$$

Assuming that equation (6) describes the condition at a time $t_1$, e.g. the start condition for the first sub-cycle for the first feeding port 120, depending on the signal measured at time $t_2$ ($>t_1$), three main scenarios are possible. Between times $t_1$ and $t_2$, the power $S_{31}^2(1)$ may remain constant, increase or decrease.

In the following, the case of a decrease of $S_{31}^2$ is described. Assuming that $P_1^{source}(1)$ is kept constant between times $t_1$ and $t_2$, a decrease of $S_{31}^2$ may indicate that:

i. the losses in the dielectric load $P_{1,loss}^{dielectric}$) has increased;

ii. the reflection at the first feeding port ($S_{11}^2(1)$) has increased; or iii. the first mode fed from the first feeding port is distorted.

It will be appreciated that the case in which both the losses in the dielectric load and the reflection measured at the first feeding port have increased is normally not possible.

An increase of the losses in the dielectric load is generally desired. However, an increase of the reflection and a distortion of the mode is generally not desired. Methods for determining the origin of the decrease of $S_{31}^2$ is described in the following.

An increase of the reflection may be detected using a measuring unit, such as the measuring unit 166 described with reference to FIG. 1, for measuring at the first feeding port the signal reflected from the cavity. The control unit 180 may be connected to the microwave source 110 corresponding to the first feeding port 120 and the measuring unit 166 such that the microwave source 110 sweeps its frequency across the allowable bandwidth and the measuring unit 166 measures the signal reflected from the cavity 150. The control unit 180 is adapted to identify resonance frequencies in the cavity 150 based on the signal measured by the measuring unit 166. In this respect, the identified resonance frequencies are the frequencies corresponding to reflection minima in the measured signal. Optionally, the control unit 180 may be adapted to identify the resonance frequencies whose reflection minima are below a predetermined magnitude (or threshold value).

Depending on the reflection characteristics, different actions may be taken to reduce the reflection. For example, if the frequency corresponding to a reflection minima in the reflection characteristics measured at time $t_2$ corresponds to the operating frequency (i.e. the frequency at time $t_1$), the control unit 180 may increase the output power level of the first microwave generator 120 and/or the time of operation of the first microwave generator 120 and remain the operating frequency unchanged.

According to another example, if the frequency for best match measured at time $t_2$ (i.e. the frequency corresponding to a reflection minima in the reflection characteristics) does not correspond to the operating frequency selected at time $t_1$ (slight shift in frequency) and the value of the reflection minima corresponding to the frequency for best match at time $t_2$ is the same as that measured during a previous measurement (e.g. at time $t_1$, the start of the operation cycle), the control unit 180 may regulate the first microwave source 120 such that its operating frequency corresponds to the frequency for best match and its output power level remains unchanged.

According to yet another example, if the frequency for best match at time $t_2$ is largely shifted in comparison to the operating frequency, the control unit 180 may be adapted to regulate the first microwave generator 180 such that the operating frequency remains unchanged and the output power level is increased since a large shift in frequency may result in a mode change.

According to a further example, if the frequency for best match at time $t_2$ is slightly shifted in comparison to the operating frequency at time $t_1$ and the value of the reflection minima corresponding to the best match frequency is different than the value of the reflection minima for the operating frequency measured at time $t_1$, the control unit 180 may regulate the first microwave generator 110 such that the operating frequency is slightly shifted to the best match frequency and the output power level is either increased or decreased in view of the value of the reflection minima corresponding to the best match frequency (alternatively, the control unit 180 may increase or reduce the time of operation of the first microwave generator 110).

A decrease of $S_{31}^2$ may also originate from a mode distortion. A mode distortion may not necessarily be a drawback with respect to electrical and heating efficiency. However, the loss of the control of the mode balancing may cause an unexpected heating pattern. In a worst case scenario, the heating pattern corresponding to the distorted mode fed via the first feeding port may cancel the heating pattern fed from the second feeding port.

A distortion in the first mode fed from the first feeding port may be identified using at least one additional field sensor 164 arranged at a third location of the cavity 150 for measuring the field strength representative of the first mode fed from the first feeding port. Multiple sensors may be used to measure the field strength of the same mode at different locations. Advantageously, the additional field sensor 164 is arranged in a region of the cavity corresponding to a minimum field strength for the mode fed from the first feeding port. The additional field sensor 164 may be arranged at a location close to a minimum field strength or at a location corresponding to the minimum field strength. The control unit 180 may be configured to analyze the difference between the signals from these sensors, thereby providing information about any mode distortion. Advantageously, both sensors associated with the first feeding port 120 are sufficiently decoupled from the first feeding port 120 and are preferably arranged in an orthogonal fashion in relation to the second feeding port 122.

It will be appreciated that the scenario corresponding to an increase of the power $S_{31}^2$ detected at the first field sensor 160 is analogous to the above described scenario for a decrease of $S_{31}^2$.

Further, if $S_{31}^2$ remains constant between times $t_1$ and $t_2$, the control unit 180 may be configured to determine whether there has been a mode distortion. The determination of the mode distortion is performed in a similar manner as that described above for the case of a decrease of $S_{31}^2$, i.e. using an additional field sensor 164 arranged at a location for measuring the field strength of the mode fed from the first feeding port 120.

It will be appreciated that a similar reasoning may be applied for regulation of the microwaves fed from the second feeding port 122 (i.e. the microwaves generated by the second microwave source 112) during the second part of the first subcycle, i.e. the case where the first feeding port 120 is inactive and the second feeding port 122 is active. For regulation of the microwaves fed from the second feeding port 122, the following expression of the power detected at the second field sensor 162 may be used:

$$S_{42}^2(1)=P_2^{source}(1)-S_{22}^2(1)-P_{2,loss}^{dielectric}(1)=P_2^{source}(1)-[P_{2,loss}^{dielectric}+S_{22}^2(1)] \quad \text{(Equation 7)}$$

For regulation of the second microwave generator 122 during the second part of the first sub-cycle, the signal measured by the first field sensor and the input reflection measured at the first feeding port during the first part of the first subcycle are advantageously recorded and stored in a memory. For example, if the reflected signal measured at the second feeding port is very close to the reflected signal measured at the first feeding port during the first part of the first subcycle and the power provided by the second generator is the same as the power provided by the first generator, both the power absorbed by the dielectric load and the signal measured at the second field sensor (if similarly decoupled from the feeding port) shall be very close to the power absorbed by the dielectric load and the signal measured at the first field sensor during the first part of the first subcycle with the first feeding port being active.

In general, $S_{11}^2$ and $S_{22}^2$ may vary between 0 and 1. In the extreme case where $S_{11}^2=S_{22}^2=0$, all the power available to the cavity is in principle absorbed by the dielectric load (it is only the decoupled, relatively small, portion of the power going to the field sensor which is excluded). Further, in an extreme case where $S_{11}^2=S_{22}^2=1$, the dissipation in the dielectric load and the field sensors is null.

In the following, simultaneous feeding of the microwaves into the cavity is described in more detail.

Using simultaneous feeding, the difference between the field strengths measured at the first and the second field sensors may be regulated by the control unit 180. The difference can be expressed as:

$$S_{31}^2-S_{42}^2=P_1^{source}(1)-P_2^{source}(1)-[P_{1,loss}^{dielectric}(1)-P_{2,loss}^{dielectric}(1)]-[S_{11}^2-S_{22}^2] \quad \text{(Equation 9).}$$

Advantageously, as for sequential feeding, the sensors are decoupled from their respective feeding ports.

According to an embodiment, the control unit is adapted to regulate the microwave sources such that the difference between the field strengths measured at the first and the second field sensors is below a predetermined value. Alternatively, the difference may be comprised within a predetermined range. Alternatively, the difference may be kept constant. According to Equation 9, if the reflected signals measured at the feeding ports and the powers of the microwave generators are kept constant, the same energy dissipation is obtained in the dielectric load for the first and the second modes if the difference between the sensor signals is monitored such that it is kept constant. With such a regulation, almost equal heating (same energy dissipation) is obtained for the two modes.

For example, the first and second field sensors may be adapted to measure currents representative of the field strengths detected at two specific locations, respectively, in the cavity. The control unit 180 may be adapted to subtract the two values, e.g. currents, measured by the field sensors for comparison and, then, regulate the microwave sources such that the difference is null or at least below a predetermined value.

A drawback of simultaneous feeding is the decoupling of unwanted frequency components inside the cavity and the field cancellation. The risk for field cancellation may be reduced by using orthogonal feeding of the cavity.

In the case of simultaneous feeding, the control unit may be adapted to regulate the frequency, the power and/or the phase of the microwaves generated by at least one of the microwave sources. For regulation of the microwave generators, the microwave heating device may be equipped with the same means and features as the microwave heating device described above for sequential feeding. For instance, the microwave heating device may be equipped with one or more measuring units for measuring the signal reflected from the cavity for a particular feeding port.

It will be appreciated that the regulation of the phase of the microwaves transmitted into the cavity via the feeding ports is particularly advantageous for simultaneous feeding. In particular, the control unit may be adapted to regulate the phase-shift between the microwaves transmitted from the first and second feeding ports. The regulation of the phase-shift enables the adjustment of the resulting heating patterns. To exemplify, if the two feeding ports were adapted to feed the same mode at opposite phases, the two microwave generators would, in principle, cancel their respective heating patterns and the resulting heating pattern would be null, or at least not efficient. To the contrary, if the two feeding ports were adapted to feed the same mode at the same phase, the two microwave fields would be added, thereby resulting in an efficient heating pattern. Although the two feeding ports of the microwave heating device of the present invention are adapted to feed different modes, the above example illustrates that the control unit may preferably be adapted to regulate the phase-shift between the two modes for optimizing the heating pattern resulting from the addition of the two modes.

According to an embodiment of the present invention, the control unit 180 may be adapted to regulate the parameters of the microwave sources based upon a predetermined cooking function and/or a predetermined load. The present embodiment is advantageous in that various cooking functions and/or types of load may require different types of heating pattern. It can be envisaged that, for a certain cooking function, some of the regulating conditions are more suitable than others. For instance, instead of keeping the difference between the field strength measured for the first mode and the field strength measured for the second mode null, or at least below a predetermined value, i.e. having the same energy dissipation in the dielectric load for both modes, it may be preferable to keep the field strengths of the two modes at another constant value. Further, a certain cooking function may preferably be achieved using a cold-centre mode rather than a hot-centre mode (or vice versa). The cooking function or type of load may be a user-defined parameter. For this purpose, the microwave oven 100 may be provided with usual push buttons and knobs, as denoted by 190 in FIG. 1, for setting operation parameters such as cooking function and type of load, as well as a display 195. For example, in the case of simultaneous feeding, a cooking function selected by a user may automatically determine the difference to be kept between the signals measured from the two field sensors. Alternatively, in the case of sequential feeding, a predefined cooking function may determine the parameters, such as the time of operation, for each of the feeding ports.

Figure 5:
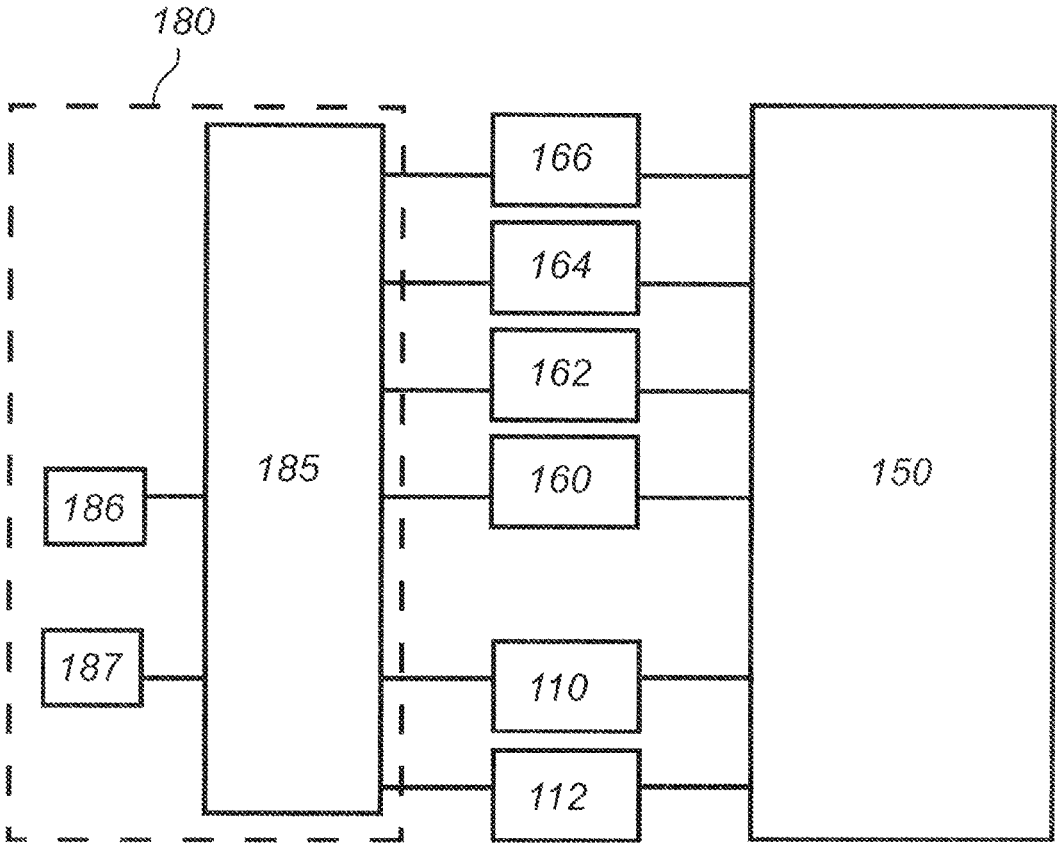
FIG. 5 shows a block diagram illustrating the general functions of the microwave heating device according to an embodiment of the present invention.

The general function of the microwave oven 100 of the present invention is further illustrated in FIG. 5 in the form of a block diagram. The generators 110 and 112 feed microwaves into the cavity 150. Further, two field sensors 160 and 162 are arranged in the cavity 150 for measuring the field strengths of a first mode fed into the cavity from a first feeding port associated with a first generator 110 and a second mode fed into the cavity from a second feeding port associated with a second generator 112. Optionally, additional field sensors may be arranged in the cavity for measuring the signal strengths of the modes fed into the cavity at other locations than the first and second locations corresponding to the first and second field sensors, respectively. The signals from the field sensors are transmitted to a control unit 180. Optionally, the signal reflected from the cavity 150 for a specific feeding port may be measured by a measuring unit 166 and the measured signal is transmitted to the control unit 180. It will be appreciated that, although the above example shows only one measuring unit associated with the first feeding port, each of the feeding ports may be equipped with a measuring unit. The control unit 180 may comprise a processor 185 for analyzing the field strengths measured by the field sensors and/or the signal(s) measured by the measuring unit(s). The control unit 180 further comprises a storage medium 186 for storing the field strength(s) and signal(s) measured at different times of an operation cycle for comparison and identification of any change between two times (or time periods) of an operation cycle. As mentioned above, the control unit 180 may also comprise a clock system 187.

Figure 6:
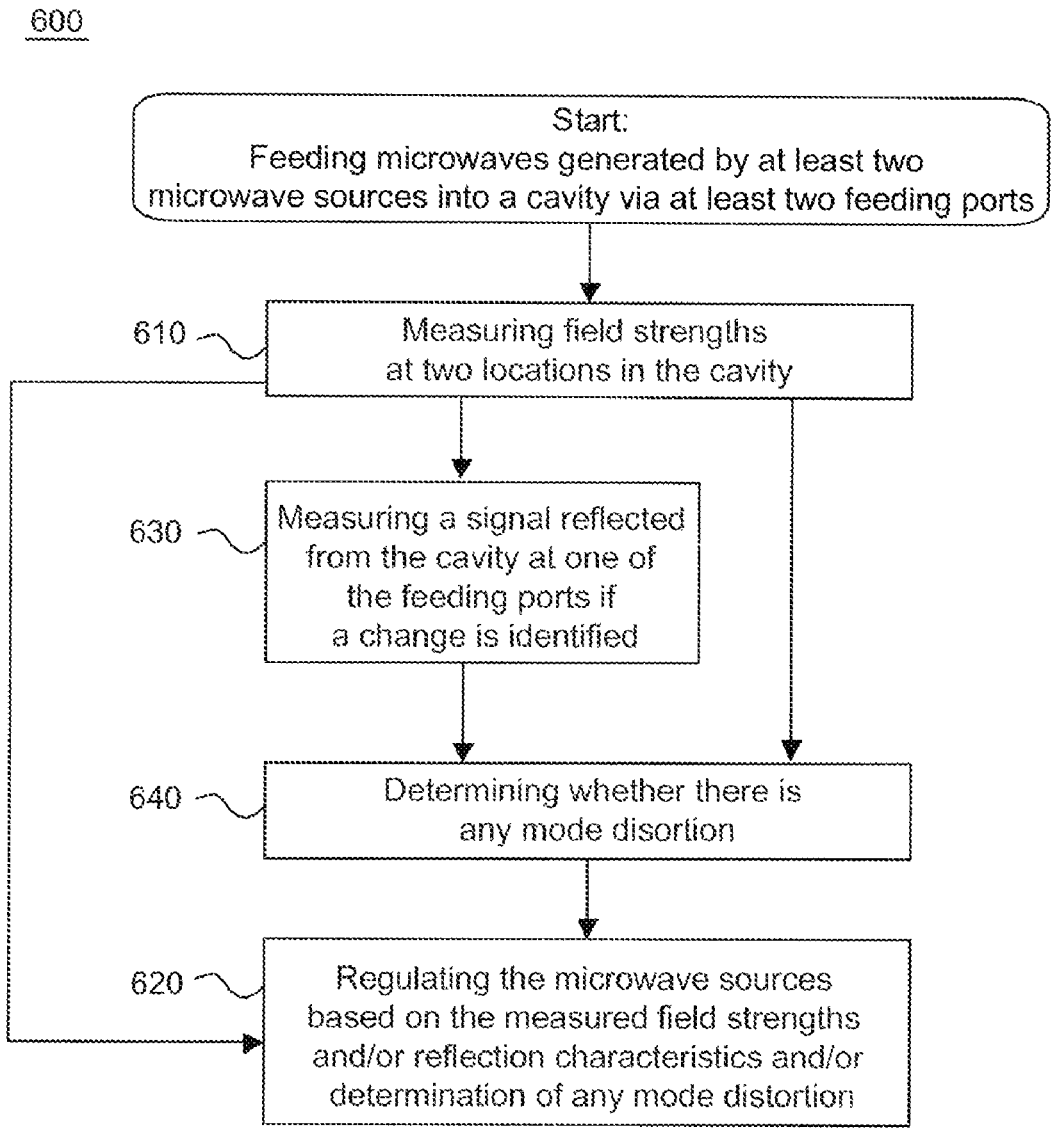
FIG. 6 is a general outline of the method of the present invention.

General steps of the method 600 according to the present invention are outlined in FIG. 6. The method 600 is performed in a cavity 150 adapted to receive a load. The microwaves are fed into the cavity from at least two microwave sources through at least two feeding ports, respectively. The method comprises the step of measuring 610 the field strengths of the microwave energy in the cavity at a first location for measuring the field strength representative of a mode fed from a first feeding port 120 and at a second location for measuring the field strength representative of a mode fed from a second feeding port 122. The method further comprises the step of regulating 620 the microwave sources based on the measured field strengths.

According to an embodiment, at least one parameter of the group comprising the frequency, the output power level, the time of operation during a portion of an operation cycle and the phase of the microwaves output from at least one of the microwave sources is regulated.

The microwaves sources may be operated either simultaneously or in sequence.

According to an embodiment, the method further comprises the step of determining whether there is a change in field strength between two subsequent portions of an operation cycle at the first and/or second locations.

Further, if a change is identified, the method further comprises the step of measuring 630 a signal reflected from the cavity for the microwaves fed from the feeding port corresponding to the location at which a change is identified. With such a measurement, it is determined whether the change in measured signal originates from a change in reflected signal.

Alternatively or in addition, the method further comprises the step of determining 640 whether the mode fed from the feeding port corresponding to the location at which a change has been identified is distorted. As mentioned earlier, the determination of a mode distortion may be performed although no change in the measurements made with the field sensors is identified.

The determination of whether there is a change in the reflected signal and/or whether there is a distortion of the mode can then be used to regulate the parameters of the microwave sources.

As mentioned above, the optimal parameters (sequence order, time of operation and output power level) may also depend on a predetermined cooking function and/or a predetermined type of load entered by a user. Advantageously, the storage medium 186 of the control unit 180 is implemented as a look-up table wherein a correspondence is established between preferred parameters for the microwave sources and predefined cooking functions and/or predefined loads.

Although the above example is based on a cavity having a rectangular enclosing surface defined by Cartesian coordinates, it will be appreciated that the present invention may also be implemented with a cavity having an enclosing surface defined by any set of orthogonal curvilinear coordinates.

Although the cavity of the present embodiment comprises two separate feeding ports, it will be appreciated that the present invention is not limited to such an embodiment and that a cavity comprising more than two feeding ports is also within the scope of the present invention.

Generally, referring to the above examples, the preferred mode fields selected during design of a cavity are mode fields resulting in complementary heating patterns, thereby improving uniform heating.

The present invention is applicable for domestic appliances using microwaves for heating such as a microwave oven.

The method of the present invention as described above may also be implemented in a computer program that, when executed, performs the inventive method in a microwave oven.

While specific embodiments have been described, the skilled person will understand that various modifications and alterations are conceivable within the scope as defined in the appended claims.

We claim:

1. A microwave heating device comprising:

a cavity adapted to receive a load to be heated;

at least two microwave sources connected to the cavity for feeding microwave energy into the cavity via at least two feeding ports, respectively;

at least two field sensors adapted to measure field strengths of the microwave energy in the cavity, wherein a first field sensor is arranged at a first location for measuring the field strength representative of a mode fed from a first feeding port and a second field sensor is arranged at a second location for measuring the field strength representative of a mode fed from a second feeding port; and a control unit connected to the microwave sources and adapted to regulate the microwave sources based on the measured field strengths.

2. The microwave heating device according to claim 1, wherein the first field sensor is arranged in a region of the cavity corresponding to a maximum field strength for the mode fed from the first feeding port and the second field sensor is arranged in a region of the cavity corresponding to a maximum field strength for the mode fed from the second feeding port.

3. The microwave heating device according to claim 1, wherein the mode fed from the first feeding port is a hot-centre mode and the mode fed from the second feeding port is a cold-centre mode.

4. The microwave heating device according to claim 1, wherein the control unit is adapted to regulate the microwave sources for sequential feeding, via the feeding ports, of the microwaves into the cavity.

5. The microwave heating device according to claim 1, wherein the control unit is adapted to regulate, for an operation cycle, at least one of a sequence order for sequential feeding of the microwaves into the cavity via the feeding ports, a time of operation of the microwave sources during a portion of the operation cycle, a frequency of the microwaves generated by at least one of the microwave sources and a output power level of at least one of the microwave sources.

6. The microwave heating device according to claim 1, further comprising at least one additional sensor arranged at a third location of the cavity for measuring the field strength representative of one of the modes fed from the first or second feeding port.

7. The microwave heating device according to claim 6, wherein the additional sensor is arranged in a region of the cavity corresponding to a minimum field strength for the mode fed from the first or second feeding port.

8. The microwave heating device according to claim 6, further comprising a measuring unit for measuring a signal reflected from the cavity as a function of an operating frequency of the microwave source associated with either one of the first or second feeding port.

9. The microwave heating device according to claim 1, wherein the control unit is adapted to regulate the microwave sources for simultaneous feeding of the microwaves into the cavity.

10. The microwave heating device according to claim 9, wherein the control unit is adapted to regulate at least one parameter of a group comprising a frequency, a power and a phase of the microwaves generated by at least one of the microwave sources.

11. The microwave heating device according to claim 9, wherein the control unit is adapted to regulate the microwave sources such that a difference between the measured field strengths is below a predetermined value, comprised within a predetermined range or kept constant.

12. A method of heating a load arranged in a cavity using microwaves fed into the cavity from at least two microwave sources through at least two feeding ports, respectively, the method comprising:

measuring field strengths of the microwave energy in the cavity at a first location for measuring a field strength representative of a mode fed from a first feeding port and at a second location for measuring a field strength representative of a mode fed from a second feeding port; and regulating the microwave sources based on the measured field strengths.

13. The method according to claim 12, wherein at least one parameter of a group comprising a frequency, an output power level, a time of operation during a portion of an operation cycle and a phase of the microwaves generated by at least one of the microwave sources is regulated.

14. The method according to claim 12, wherein the microwaves sources are operated either simultaneously or in sequence.

15. The method according to claim 12, further comprising:

measuring a signal reflected from the cavity for the microwaves fed from the feeding port corresponding to one of the locations at which a change in field strength between two subsequent portions of an operation cycle is identified; and/or determining whether the mode fed from one of the feeding ports is distorted.

* * * * *